US009475302B2

(12) United States Patent
Yamaguchi et al.

(10) Patent No.: US 9,475,302 B2
(45) Date of Patent: Oct. 25, 2016

(54) INK JET PRINTING APPARATUS AND INK JET PRINTING METHOD

(71) Applicant: CANON FINETECH INC., Misato-shi, Saitama (JP)

(72) Inventors: Kenro Yamaguchi, Noda (JP); Takashi Sugai, Noda (JP); Noritaka Ota, Kashiwa (JP)

(73) Assignee: Canon Finetech, Inc., Misato-shi (JP)

( * ) Notice: Subject to any disclaimer, the term of this patent is extended or adjusted under 35 U.S.C. 154(b) by 0 days.

(21) Appl. No.: 14/489,745

(22) Filed: Sep. 18, 2014

(65) Prior Publication Data

US 2015/0085004 A1 Mar. 26, 2015

(30) Foreign Application Priority Data

Sep. 20, 2013 (JP) ..... 2013-195873
Sep. 20, 2013 (JP) ..... 2013-195875
Mar. 20, 2014 (JP) ..... 2014-058462

(51) Int. Cl.
*B41J 29/38* (2006.01)
*B41J 2/175* (2006.01)
*B41J 2/14* (2006.01)

(52) U.S. Cl.
CPC ..... *B41J 2/17566* (2013.01); *B41J 2/14* (2013.01); *B41J 2/175* (2013.01); *B41J 2/1752* (2013.01); *B41J 29/38* (2013.01); *B41J 2002/17579* (2013.01)

(58) Field of Classification Search
CPC ..... B41J 2/17556
See application file for complete search history.

(56) References Cited

U.S. PATENT DOCUMENTS 6,976,753 B2 12/2005 Kuwabara et al.
8,038,274 B2 10/2011 Ujita et al.
8,342,661 B2 1/2013 Takahashi et al.
8,939,558 B2 1/2015 Katoh et al.
2009/0315959 A1* 12/2009 Fukazawa ..... B41J 2/175 347/85
2011/0063344 A1* 3/2011 Satoh ..... B41J 2/17509 347/7
2011/0134171 A1* 6/2011 Leighton ..... B41J 2/175 347/7

(Continued)

FOREIGN PATENT DOCUMENTS

EP 2072266 A1 6/2009
EP 2617572 A1 7/2013

(Continued)

OTHER PUBLICATIONS

Ishizu, Tomohiro, Inkjet Recording Device, Jul. 4, 2013, Japan, pp. 1-17.*

(Continued)

*Primary Examiner* — Erica Lin
*Assistant Examiner* — Tracey McMillion
(74) *Attorney, Agent, or Firm* — Fitzpatrick, Cella, Harper & Scinto

(57) ABSTRACT

An ink jet printing apparatus includes a print head configured to be able to eject an ink fed from an ink tank that contains the ink in a closed space so as to apply a negative pressure to the ink, a communication path configured to allow a liquid chamber in the print head to communicate with an outside of the liquid chamber, an opening and closing unit configured to open and close the communication path, and a control unit configured to open the communication path in accordance with a pressure in the print head via the opening and closing unit, to bring the liquid chamber and the outside into communication with each other.

13 Claims, 13 Drawing Sheets

(56) References Cited

U.S. PATENT DOCUMENTS

| | | | | |
|---|---|---|---|---|
| 2013/0187985 | A1* | 7/2013 | Katoh | B41J 2/135 347/47 |
| 2014/0285585 | A1 | 9/2014 | Yazaki et al. | |
| 2014/0285586 | A1 | 9/2014 | Fukuda et al. | |

FOREIGN PATENT DOCUMENTS

| | | | |
|---|---|---|---|
| EP | 2781356 | A1 | 9/2014 |
| EP | 2781357 | A1 | 9/2014 |
| JP | 8-336985 | A | 12/1996 |
| JP | 2003-039705 | A | 2/2003 |
| JP | 2004-122500 | A | 4/2004 |
| JP | 2004-188720 | A | 7/2004 |
| JP | 2007-313711 | A | 12/2007 |
| JP | 2010-274607 | A | 12/2010 |
| JP | 2011-000823 | A | 1/2011 |
| JP | 2011-235605 | A | 11/2011 |
| JP | 2013-129163 | A | 7/2013 |

OTHER PUBLICATIONS

European Search Report issued in European patent Application No. 14185289.7, dated Feb. 18, 2015.

Office Action in Japanese Patent Application No. 2014-058462, dated Aug. 18, 2015.

* cited by examiner

INK JET PRINTING APPARATUS AND INK JET PRINTING METHOD

BACKGROUND OF THE INVENTION

1. Field of the Invention

The present invention relates to an ink jet printing apparatus and an ink jet printing method in which an image is printed using an ink tank that contains ink in a closed space so as to apply a negative pressure to the ink and a print head that can eject the ink fed from the ink tank.

2. Description of the Related Art

In an ink jet printing apparatus, ink with a negative pressure applied thereto is fed from an ink tank to a print head and then ejected through ejection ports in the print head using an ejection energy generating element such as an electrothermal transducing element (heater) or a piezo element. Such a printing apparatus is used in a narrow space, for example, on a checkout counter or in a shelf in a store or on a desk in an office. Thus, there has been a demand for a reduction in the size of the printing apparatus.

For a reduced size of the printing apparatus, ideally the print head and the ink tank are directly coupled together. Furthermore, to allow a large amount of ink to be contained while enabling a reduction in the size of the ink tank or the printing apparatus, a closed ink tank is advantageously used. In the closed ink tank described in Japanese Patent Laid-Open No. 2007-313711, a flexible bag containing ink is provided and biased, using a spring or the like, in a direction in which the internal volume of the bag is increased, to apply a negative pressure to the ink to be fed to the print head.

In the closed ink tank, the flexible bag containing ink forms a closed space that communicates only with the print head. Thus, for example, if the ink in the ink tank is exhausted to collapse the flexible bag with an amount of ink remaining in the print head, the negative pressure in the print head increases when the print head ejects the ink remaining inside the print head. This may preclude the ink from being appropriately ejected, leading to inappropriate image printing.

SUMMARY OF THE INVENTION

The present invention provides an ink jet printing apparatus and an ink jet printing method both of which allow ink in a closed ink tank and in a print head to be stably ejected.

In the first aspect of the present invention, there is provided an ink jet printing apparatus comprising:

a print head configured to be able to eject an ink fed from an ink tank that contains the ink in a closed space so as to apply a negative pressure to the ink;

a communication path configured to allow a liquid chamber in the print head to communicate with an outside of the liquid chamber;

an opening and closing unit configured to open and close the communication path; and a control unit configured to open the communication path in accordance with a pressure in the print head via the opening and closing unit, to bring the liquid chamber and the outside into communication with each other.

In the second aspect of the present invention, there is provided an ink jet printing method for printing an image by ejecting, from a print head, ink fed from an inside of a closed space in an ink tank to which a negative pressure is applied, the method comprising:

a step of introducing a pressure equal to or greater than a predetermined negative pressure into the print head when the negative pressure in the print head becomes equal to or greater than the predetermined negative pressure.

According to the present invention, the opening and closing unit opens the communication path in accordance with the pressure in the print head to bring the outside and the print head into communication with each other, thus relaxing the negative pressure in the print head. This enables the ink in the closed ink tank and in the print head to be stably ejected.

Further features of the present invention will become apparent from the following description of exemplary embodiments (with reference to the attached drawings).

DESCRIPTION OF THE EMBODIMENTS

Embodiments of the present invention will be described below with reference to the drawings. A printing apparatus according to the embodiments is an applied example of a full line ink jet printing apparatus.

First Embodiment

Figure 1:
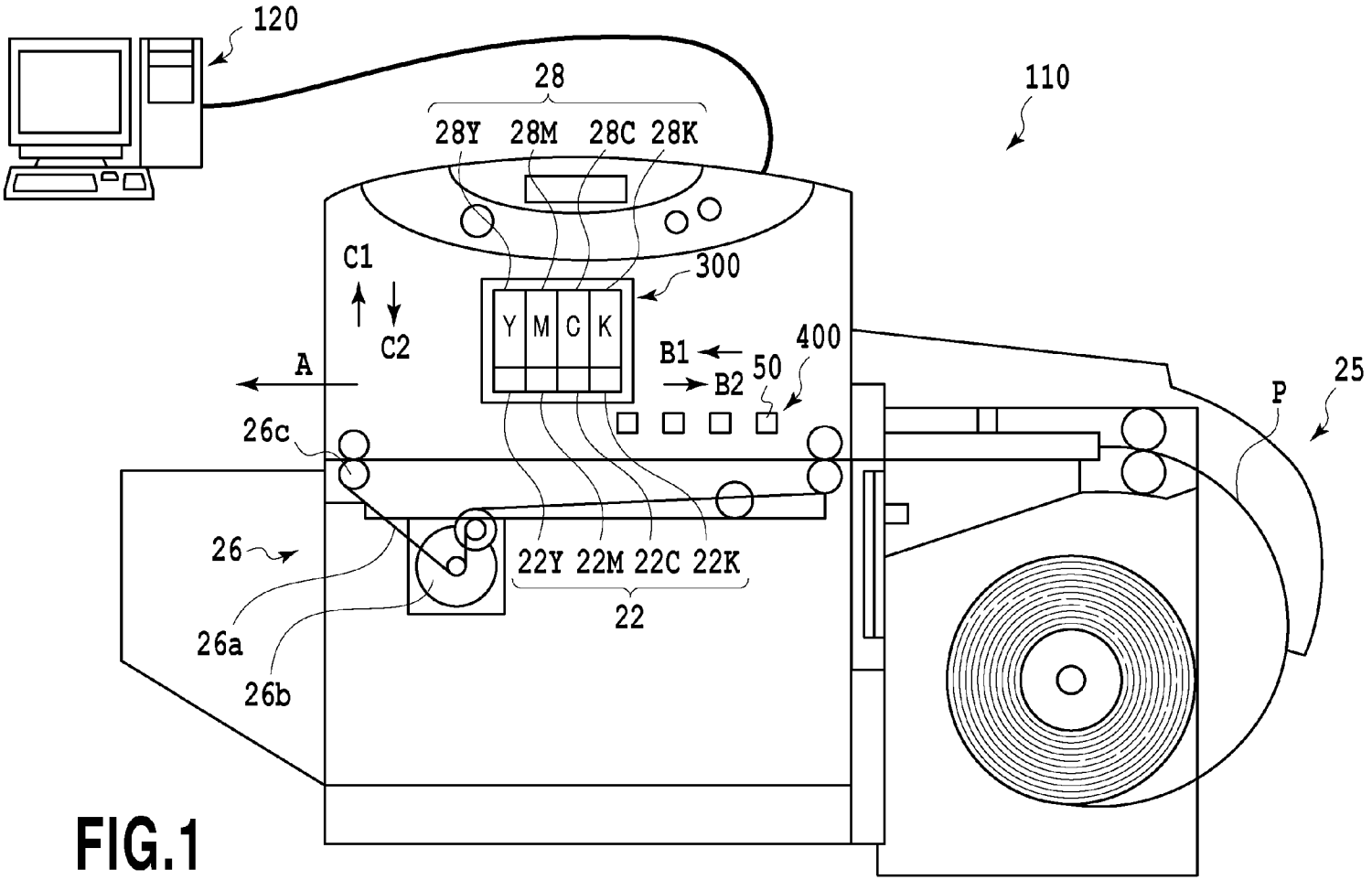
FIG. 1 is a schematic front view of an ink jet printing apparatus according to a first embodiment of the present invention.

FIG. 1 is a diagram of a conceptual example of a configuration of a full line ink jet printing apparatus (hereinafter also referred to as a "printer") 110.

The printer 110 is connected to a host apparatus 120 configured as a personal computer or the like to transmit image information to the printer 110. The printer 110 includes four print heads 22 (22K, 22C, 22M, and 22Y) capable of ejecting ink and which are arranged in juxtaposition in a direction in which rolled paper P serving as a print medium is conveyed (the direction of arrow A). The print heads 22K, 22C, 22M, and 22Y are print heads configured to eject black, cyan, magenta, and yellow, respectively. Each of the print heads 22 includes a plurality of nozzles with a plurality of ejection ports through which the corresponding ink is ejected using an ejection energy generating element such as an electrothermal transducing element (heater) or a piezo element. When the electrothermal transducing element is used, the electrothermal transducing element generates heat to bubble the ink so that the bubbling energy of the ink can be utilized to eject the ink through the ejection port at a leading end of the nozzle. The ejection ports are arranged in a direction crossing (in the present example, a direction orthogonal to) the conveying direction of arrow A. The print heads 22 are what is called elongate line heads, and the print heads 22K, 22C, 22M, and 22Y are arranged in juxtaposition in the conveying direction of arrow A. The length of each of the print heads 22 is slightly larger than the maximum width (the length in a direction orthogonal to the sheet of FIG. 1) of the print medium over which the printer 110 can achieve printing. Furthermore, the print heads 22 are placed at predetermined positions during an image printing operation.

For a recovery operation (an operation of maintaining an appropriate ink ejection state) for the print heads 22, the printer 110 incorporates a recovery unit 400. The recovery unit 400 includes recovery mechanisms (capping mechanisms) 50 configured to remove ink from corresponding surface of the print heads 22K, 22C, 22M, and 22Y on which the ejection ports are formed (ejection port formation surface). The recovery mechanisms 50 are provided independently in each of the print heads 22K, 22C, 22M, and 22Y. Each of the recovery mechanisms 50 includes a wiper that wipes the ejection port formation surface, a wiper holding member that holds the wiper, an ink removing member configured to remove ink attached to the wiper, and a cap that closely contacts the ejection port surface.

The rolled paper P is fed from a supply unit 25 and conveyed in the direction of arrow A by a conveying mechanism 26 incorporated in the printer 110. The conveying mechanism 26 includes a conveying belt 26*a* on which the rolled paper P is placed and conveyed, a conveying motor 26*b* configured to rotate the conveying belt 26*a*, and a roller 26*c* that applies tension to the conveying belt 26*a*. The conveying mechanism 26 may be configured to convey the rolled paper P using the conveying roller or may provide a conveying unit.

When an image is printed on the rolled paper P, black ink is selectively ejected though the plurality of ejection ports in the print head 22K based on print data (image information) after a printing start position on the rolled paper P being conveyed reaches a print position under the print head 22K. Similarly, inks in the respective colors are ejected from the print heads 22C, 22M, and 22Y in this order to print a color image on the rolled paper P. The printer 110 includes ink tanks 28 (28K, 28C, 28M, and 28Y) from which the respective inks are fed to the print heads 22 (22K, 22C, 22M, and 22Y). Moreover, the printer 110 includes various pumps configured to perform an ink supply operation and the recovery operation on each of the print heads 22K, 22C, 22M, and 22Y.

Figure 2:
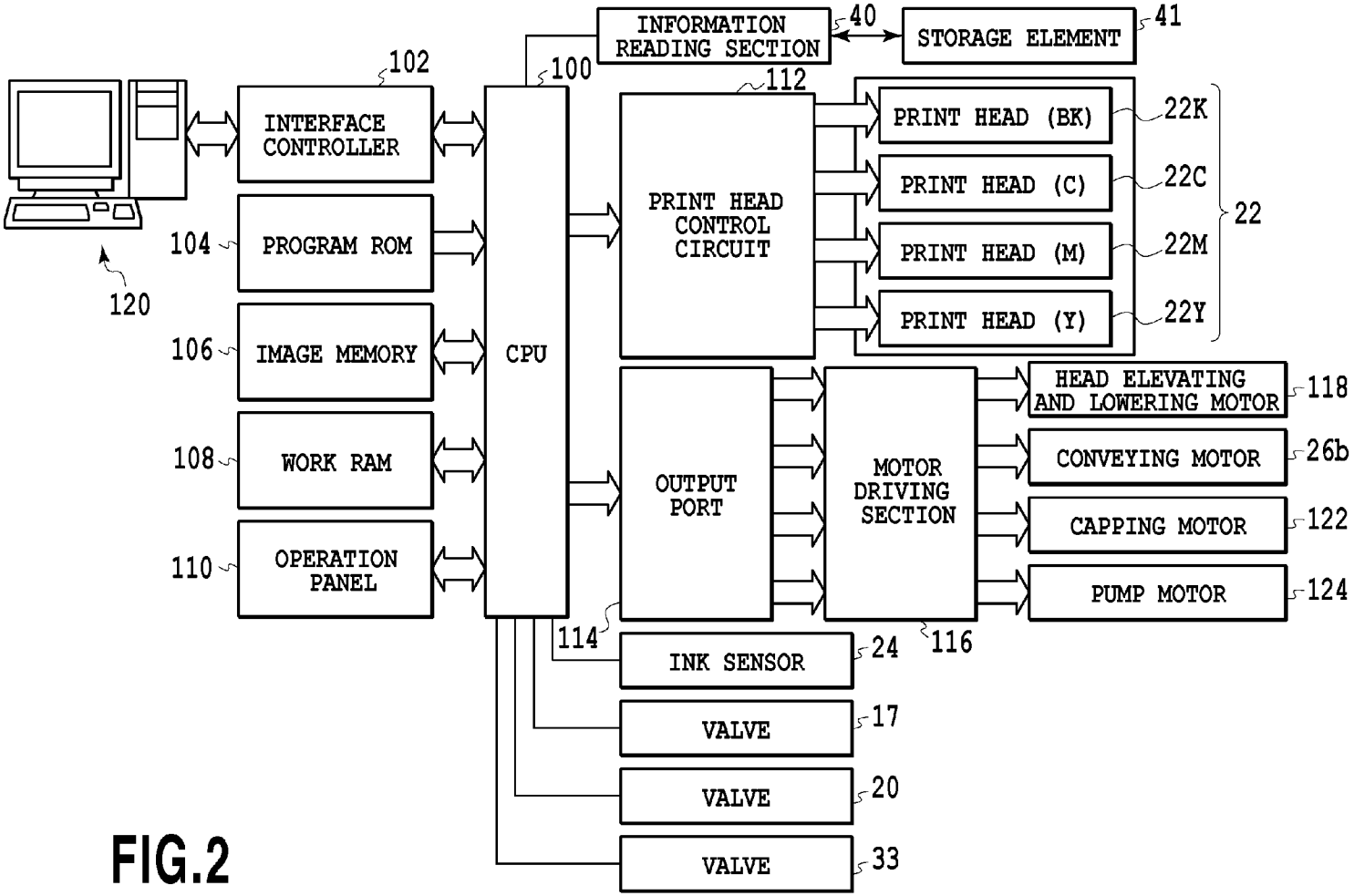
FIG. 2 is a block diagram of a control system in the ink jet printing apparatus in FIG. 1.

FIG. 2 is a block diagram of a configuration of a control system of the printer 110.

Information such as print data and commands transmitted by the host apparatus 120 is received by a CPU 100 via an interface controller 102. The CPU 100 is an arithmetic processing apparatus that is responsible for general control in the printer 110 in connection with reception of print data for the printer 110, a printing operation, and handling of the rolled paper P. The CPU 100 analyzes a received command and then decompresses image data on color components in print data into a bit map in an image memory 106 for drawing An image is printed as follows. First, a capping motor 122 and a head elevating and lowering motor 118 are controllably driven via an output port 114 and a motor driving section 116 to move the print heads 22 away from the corresponding capping mechanisms 50 to the corresponding print positions. The capping motor 122 is a motor configured to move the capping mechanism 50 in the directions of arrows B1 and B2 in FIG. 1. The head elevating and lowering motor 118 is a motor configured to elevate and lower the print head 22 in the directions of arrows C1 and C2 in FIG. 1. After the movement to the print position, a roll motor (not shown in the drawings) configured to pay the rolled paper P out, a conveying motor 26*b* configured to convey the rolled paper P at a constant speed, and the like are controllably driven via the output port 114 and the motor driving section 116 to convey the rolled paper P in the direction of arrow A. A timing (print timing) when ink starts to be ejected to the rolled paper P conveyed at the constant speed is determined based on a timing when a leading end sensor (not shown in the drawings) detects a leading end of the rolled paper P. The CPU 100 sequentially reads print data corresponding to each ink color from the image memory 106, in synchronism with conveyance of the rolled paper P. The CPU 100 then transfers the read data to the corresponding print heads 22K, 22C, 22M, and 22Y via a print head control circuit 112. Valves 17, 20, and 33 are connected to the CPU 100 which performs operations of opening and closing the valves. Furthermore, an ink sensor 24 is connected to the CPU 100 which determines whether or not a liquid chamber (described below) contains a predetermined amount of ink based on an output from the ink sensor 24.

The CPU 100 executes various processes including a negative pressure relaxation process described below (see FIG. 6) based on process programs stored in a program ROM 104. The program ROM 104 stores process programs, tables, and the like which correspond to control flows. A work RAM 108 is used as a work memory or the like. During a cleaning operation and a recovery operation for each of the print heads 22, the CPU 100 controllably drives a pump motor 124 via the output port 114 and the motor driving section 116 to allow the pump motor 124 to perform pressing, suction, and the like of the ink.

Figure 3:
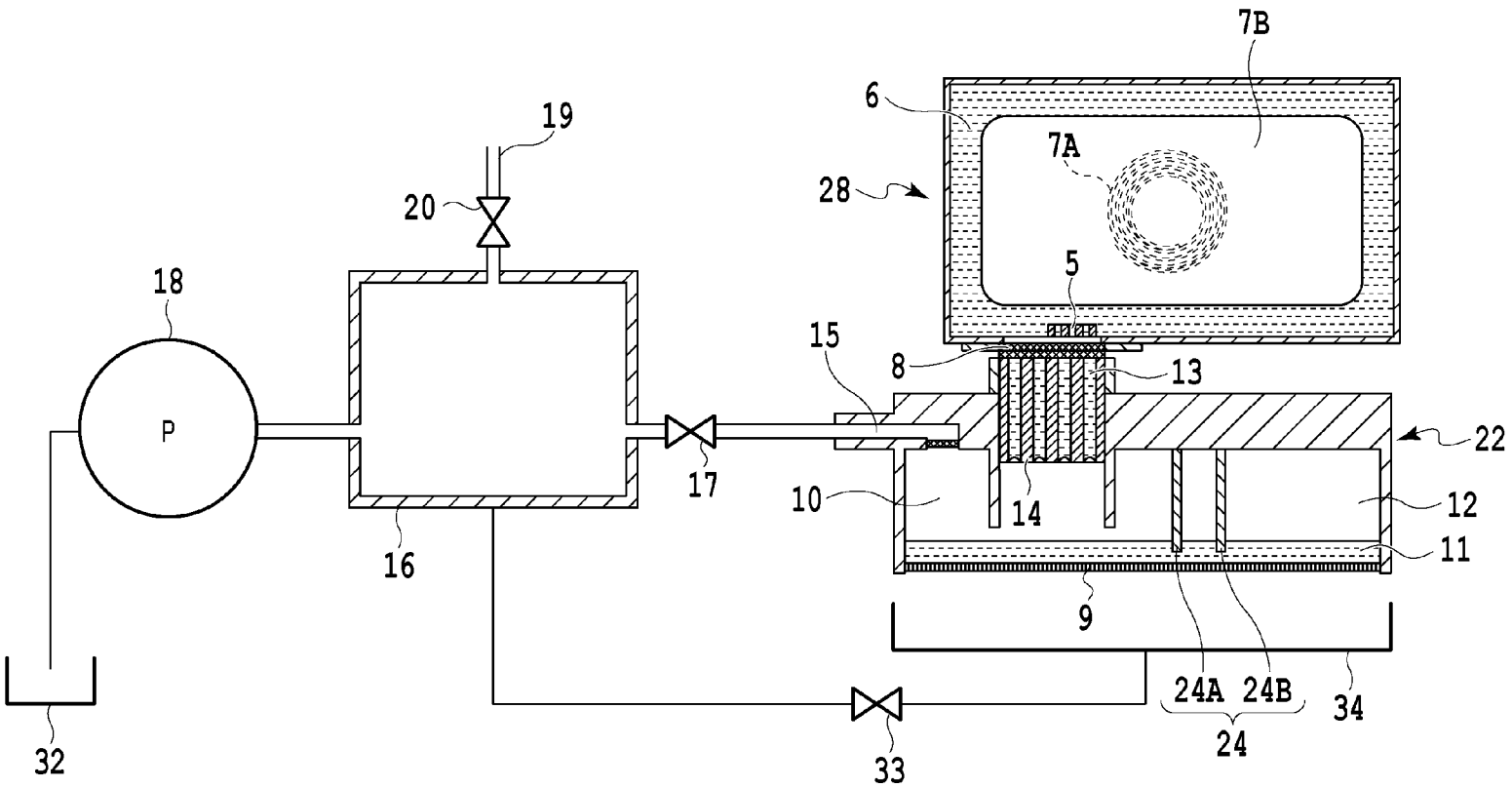
FIG. 3 is a schematic diagram of a configuration of an ink supply system in the ink jet printing apparatus in FIG. 1.
Figure 4:
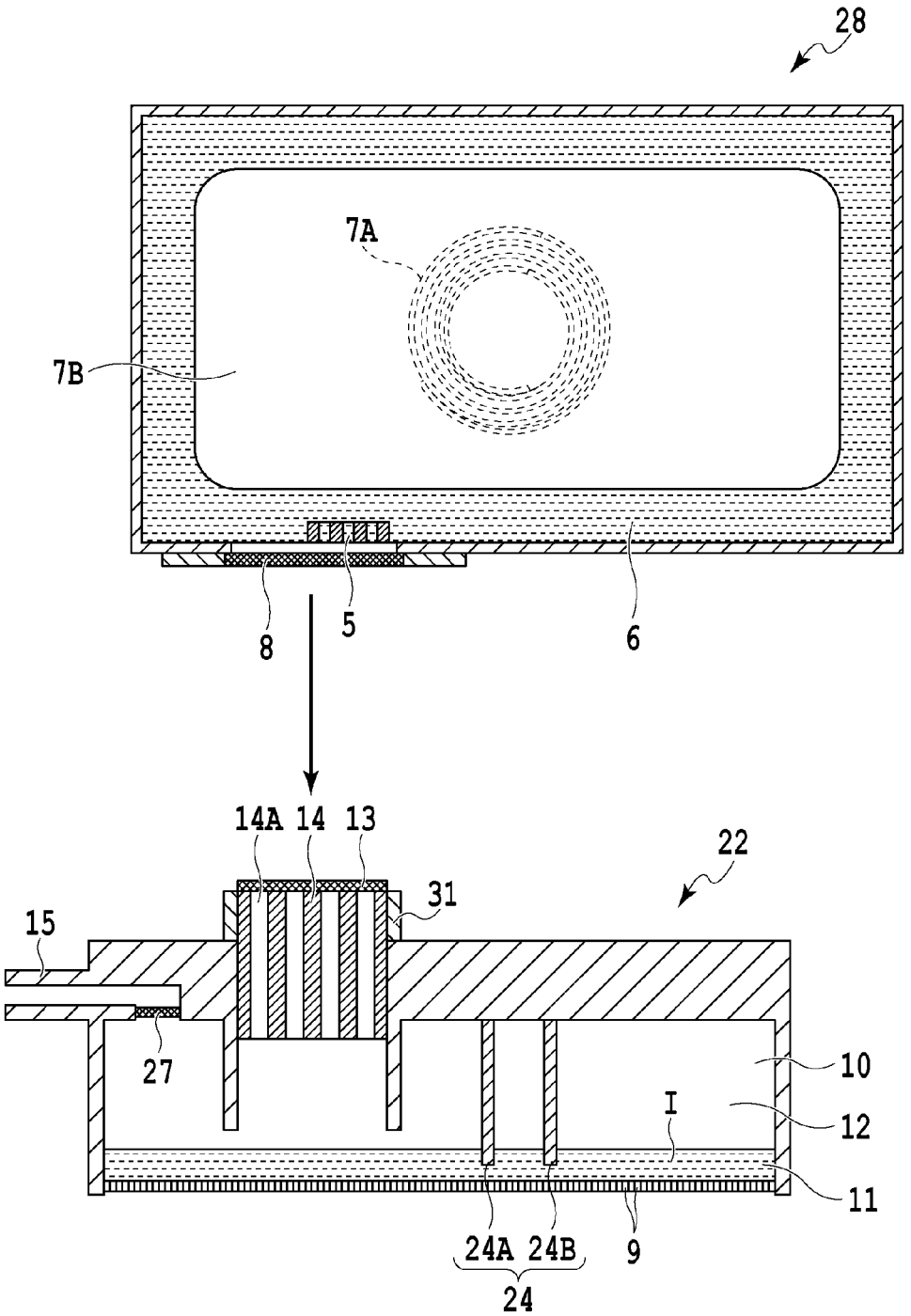
FIG. 4 is an enlarged cross-sectional view of an ink tank and a print head in FIG. 3.

FIG. 3 is a diagram of an ink supply system between the ink tank 28 and the print head 22. FIG. 4 is an enlarged cross-sectional view of the ink tank 28 and the print head 22.

The ink tank 28 is a closed ink tank including a liquid chamber 6 located inside the ink tank 28 and which communicates with the outside only via a joint portion 5, the liquid chamber 6 forming a substantial closed space. The liquid chamber 6 forming the closed space is at least partly formed of a flexible member. The liquid chamber 6 includes a spring 7A that biases the liquid chamber in a direction in which the liquid chamber 6 is expanded. The spring 7A causes a predetermined negative pressure to be generated in the liquid chamber 6. Thus, the ink tank 28 contains ink in the closed space so as to apply a negative pressure to the ink.

The spring 7A in the present example biases the liquid chamber 6 from inside toward outside via a pressure plate 7B so as to expand the internal space of the liquid chamber 6. The spring 7A and the pressure plate 7B form a negative pressure generating section. A nonwoven filter 8 is attached to the joint portion 5.

Figure 5A:
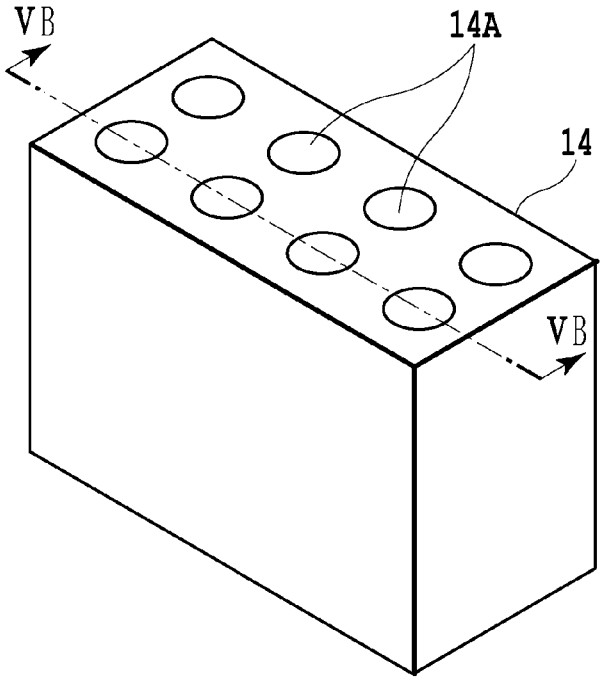
FIG. 5A and FIG. 5B are enlarged diagrams of an ink holding member in FIG. 3.
Figure 5B:
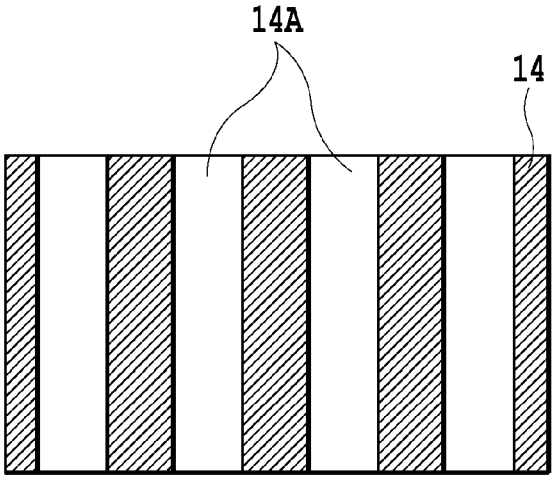

The print head 22 includes a filter 13 and an ink holding member 14 attached to a joint portion 31. The filter 13 is formed of an SUS mesh. The mesh is formed of woven metal fibers. The meshes (ink communication portions) of the filter 13 are each approximately 10 μm in average width. The fine meshes of the filter 13 prevent external dirt from entering the inside of the print head 22. The ink holding member 14 internally includes a plurality of cylindrical channels 14A each with an inner diameter of approximately 1.0 mm as shown in FIG. 5A and FIG. 5B. The filter 8 on the ink tank 28 side is brought into pressure contact with the filter 13 on the print head 22 side to connect the print head 22 and the ink tank 28 together. This brings the liquid chamber 6 in the ink tank 28 into communication with a liquid chamber (ink chamber) 10 in the print head 22.

The print head 22 includes ejection energy generating elements (not shown in the drawings) configured to eject the ink in the liquid chamber 10 through ejection ports 9. The ejection energy generating element may be an electrothermal transducing element (heater) or a piezo element. When the electrothermal transducing element is used, the electrothermal transducing element generates heat to bubble the ink so that the bubbling energy of the ink can be utilized to eject the ink through the ejection port 9. The liquid chamber 10 internally includes a space portion in which an ink layer 11 is formed and a space portion in which an air layer 12 is formed.

Ink introduced from the ink tank 28 into the print head 22 is held in the channels 14A in the ink holding member 14 to form meniscus at a lower end of each of the channels 14A. When the ink is ejected through the ejection ports 9 in the print head 22 to consume the ink in the liquid chamber 10, the volume of the ink layer 11 decreases and the volume of the air layer 12 increases to reduce the pressure in the liquid chamber 10. When the pressure in the liquid chamber 10 is lower than a predetermined pressure, the meniscus of the ink formed at the lower end of the channel 14A is broken, with the ink fed from the ink tank 28 to the print head 22. When such feeding of ink allows the pressure in the liquid chamber 10 to recover to the original predetermined pressure, the feeding of the ink from the ink tank 28 into the print head 22 stops to form meniscus at the lower end of the channel 14A again. As described above, the ink is fed from the ink tank 28 into the print head 22 through the channels 14A in the holding member 14 so as to avoid a decrease in the pressure in the liquid chamber 10 associated with consumption of the ink. The channels 14A allow ink to be fed from the ink tank 28 to the print head 22 based on a difference in pressure between the inside of the closed space in the ink tank 28 and the inside of the liquid chamber 10 in the print head 22.

The ink sensor 24 is provided in the liquid chamber 10 to detect the height of the ink layer 11. The ink sensor 24 includes two metal electrode plates 24A and 24B arranged parallel to each other. When the level of the ink layer 11 is positioned as high as or higher than lower ends of the electrode plates 24A and 24B, the electrode plates 24A and 24B are electronically continuous with each other. When the level of the ink layer 11 is positioned below the lower ends of the electrode plates 24A and 24B, the electrode plates 24A and 24B are electrically insulated from each other. Based on such electrical changes between the electrode plates 24A and 24B, the CPU 100 can determine whether or not the level of the ink layer 11 is equal to or lower than the predetermined height (the position of the lower ends of the electrode plates 24A and 24B).

The print head 22 includes, besides the joint portion 31, a communication path 15 through which the print head 22 communicates with the outside. The communication path 15 includes a filter 27 provided in an opening of the communication path 15. The communication path 15 communicates with a buffer chamber (negative pressure chamber; gas storage section) 16 via the openable and closable first valve 17. The buffer chamber 16 forms approximately 30 ml of space and communicates with the pump 18. The pump 18 in the present example is a tube pump that can be rotated forward and backward. The buffer chamber 16 connects to a channel 19 that communicates with the atmosphere, and the channel 19 includes the openable and closable second valve 20. The pump 18 connects to a waste ink tank 32.

A cap 34 is connected to the buffer chamber 16 via the openable and closable third valve 33. The cap 34 can be brought into tight contact with the surface of the print head 22 in which the ejection ports 9 are formed (ejection port formation surface). With the cap 34 kept in tight contact with the ejection port formation surface to cap the ejection ports 9, the inside of the cap 34 is sucked by the pump 18 to allow the ink to be sucked and discharged into the cap 34 through the ejection ports 9 (suction recovery operation). The following recovery operations can also be performed: a preliminary ejection operation of ejecting ink making no contribution to image printing into the cap 34 and a pressing recovery operation of pressing the ink in the print head 22 to forcibly discharge the ink into the cap 34 through the ejection ports 9. In the pressing recovery operation, a pressing force generated by the pump 18 can be allowed to act in the print head 22 through the buffer chamber 16 and the first valve 17. The ink contained in the cap 34 as a result of such a recovery process can be discharged to the waste ink tank 32 through the buffer chamber 16 using a suction force generated by the pump 18.

The ink tank 28 for each color includes a storage element 41 (storage section) that can store various pieces of information. When the ink tank 28 is installed in a main body of the printing apparatus (apparatus main body) so as to be connected to the print head 22, information stored in the storage element 41 in the ink tank 28 is read by an information reading section 40 on the apparatus main body side. The CPU 100 can perform control based on the read information and store information into the storage element 41 in the ink tank 28.

The negative pressure in the closed ink tank 28 tends to increase with decreasing amount of ink remaining in the ink tank 28 and consistently with the negative pressure in the print head 22. In particular, when the ink in the ink tank 28 is about to be exhausted, the negative pressure in the ink tank 28 tends to increase rapidly in keeping with the negative pressure in the print head 22. Thus, if the ink is further consumed when only a small amount of ink remains in the ink tank 28, the negative pressure in the liquid chamber 10 in the print head may increase even to the extent that the ink is inappropriately ejected.

In the present example, the negative pressure relaxation process is executed to suppress an increase in the negative pressure in the liquid chamber 10 in the print head 22 even during a printing operation after the amount of ink remaining in the ink tank 28 decreases, thus maintaining an appropriate ink ejection state. This enables high grade images to be printed.

Figure 6:
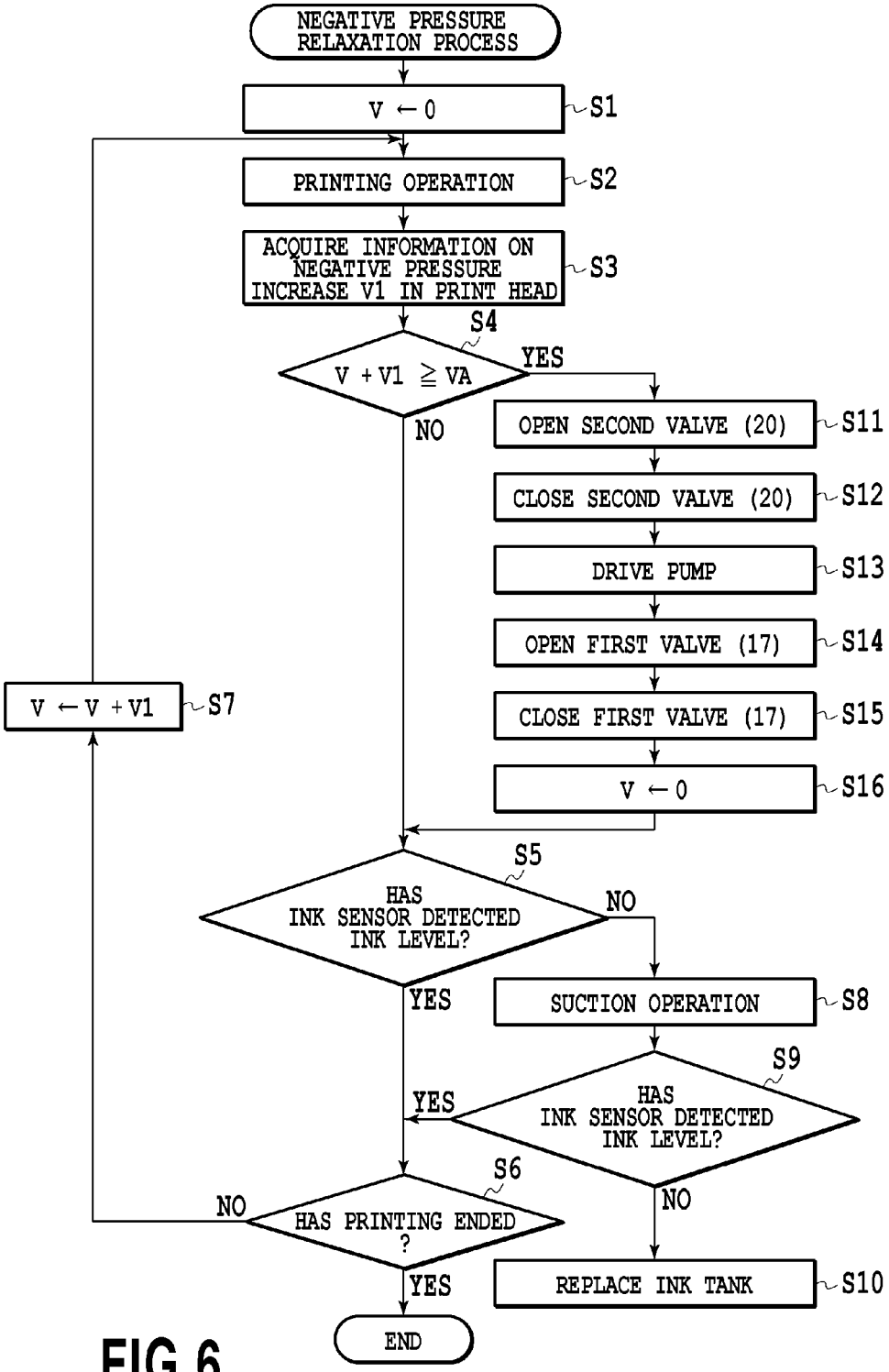
FIG. 6 is a flowchart illustrating a negative pressure relaxation process executed by the ink supply system in FIG. 3.

FIG. 6 is a flowchart illustrating the negative pressure relaxation process. FIG. 7A to FIG. 7E are diagrams illustrating how the negative pressure in the print head 22 is adjusted during the negative pressure relaxation process.

The printing apparatus sequentially measures and accumulates the amount of ink consumed since the start of use of the ink tank 28 by counting the number of times that the ink is ejected from the print head 22 during a printing operation based on print data. Moreover, the amount of ink consumed can be more accurately measured by adding the amount of ink consumed as a result of the recovery operation (including the suction recovery operation, the preliminary ejection operation, and the pressing recovery operation) to the amount of ink consumed as a result of the printing operation. The thus calculated amount of ink consumed is stored in the storage element provided in the ink tank 28. Therefore, for the ink in the ink tank 28 in which the storage element is provided, the accumulated amount of ink consumed is stored in the storage element. When the accumulated amount of ink consumed, which is stored in the storage element, is equal to or greater than a predetermined amount, the apparatus determines that the ink in the ink tank 28 is about to be exhausted and shifts to a negative pressure relaxation mode shown in FIG. 6.

When the process shifts to the negative pressure relaxation mode, first, a value V is reset which relates to an increase in the negative pressure in the liquid chamber 10 in the print head 22 measured since the shift to the negative pressure relaxation mode (step S1). An image is printed based on print data (step S2). Subsequently, information is acquired which relates to an increase V1 in the negative pressure in the liquid chamber 10 in the print head 22 (an increase in the negative pressure in the print head) caused by the printing operation in step S2 (step S3).

In the present example, the negative pressure increase V1 is predicted from the amount of ink consumed during the printing operation in step S2. That is, first, the number of times that the ink is ejected during the printing operation in step S2 is counted based on the print data. The amount of ink consumed is predicted based on the count value and the amount of ink ejected per one ejection operation. The negative pressure in the print head 22 tends to increase consistently with the amount of ink consumed, and thus, based on the amount of ink consumed, the negative pressure increase V1 in the print head 22 during the printing operation in step S2 can be predicted. Furthermore, the negative pressure increase V1 can be acquired by directly detecting the pressure in the print head 22 or in the ink tank 28.

Then, the process determines whether the total negative pressure (V+V1) of the negative pressure increase V1 and the above-described negative pressure V is equal to or higher than a predetermined negative pressure VA (step S4). The predetermined negative pressure VA is such that the appropriate ink ejection state can be maintained even when the negative pressure (V+V1) in the print head 22 increases to the extent that the predetermined negative pressure VA is not reached after the process shifts to the negative pressure relaxation mode. When the negative pressure (V+V1) exceeds the predetermined negative pressure VA, the appropriate ink ejection state may fail to be maintained.

The negative pressure (V+V1) is lower than the predetermined negative pressure VA, the process shifts to step S5. On the other hand, when the negative pressure (V+V1) is equal to or higher than the predetermined negative pressure VA, a series of processing (steps S11, S12, S13, S14, S15, and S16) for relaxing the pressure in the print head 22 is executed, and then, the process shifts to step S5 described below.

Figure 7A:
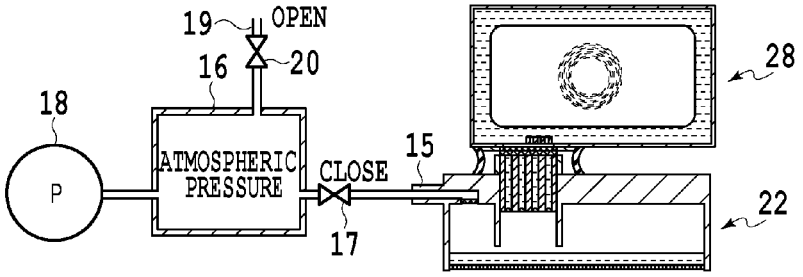
FIG. 7A, FIG. 7B, FIG. 7C, FIG. 7D, and FIG. 7E are diagrams illustrating an operation of the ink supply system during the negative pressure relaxation process in FIG. 6.
Figure 7B:
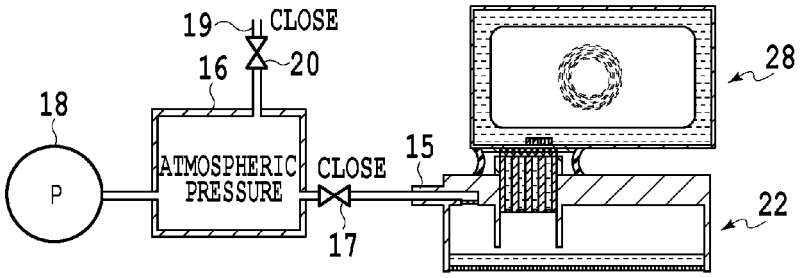
Figure 7C:
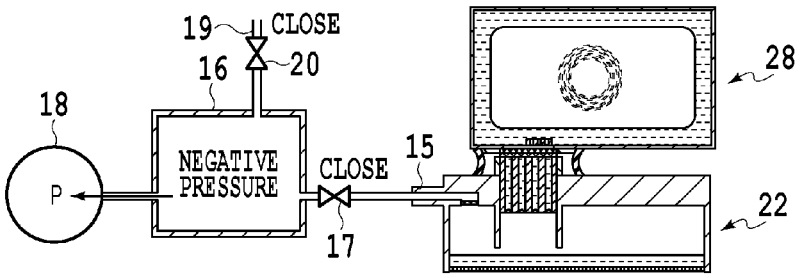
Figure 7D:
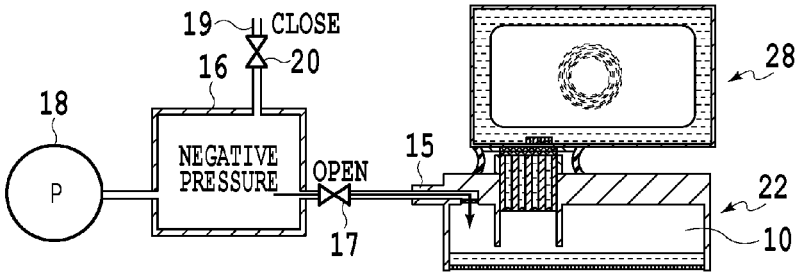
Figure 7E:
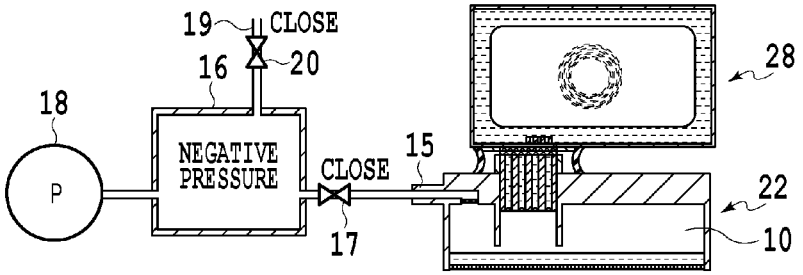

In step S11, as shown in FIG. 7A, the second valve 20 is opened with the first valve 17 and third valve 33 remaining closed to set the pressure inside of the buffer chamber 16 equal to the atmospheric pressure. Then, as shown in FIG. 7B, the second valve 20 is closed (step S12). As shown in FIG. 7C, the pump 18 is rotated in a direction in which the air in the buffer chamber 16 is discharged (step S13) to create a negative pressure in the buffer chamber 16. Subsequently, the negative pressure in the buffer chamber 16 is set at least to a smaller absolute value than the predetermined negative pressure VA, and then, the first valve 17 is opened as shown in FIG. 7D (step S14). Thus, the negative pressure in the print head 22 is relaxed. Subsequently, as shown in FIG. 7E, the first valve 17 is closed (step S15), and the negative pressure V is reset (step S16).

The negative pressure in the liquid chamber 10 of the print head 22 is desirably reduced to a value within the ideal, appropriate range of negative pressures at which the appropriate ink ejection state can be maintained. Furthermore, by reducing the pressure in the buffer chamber 16 before the buffer chamber 16 and the print head 22 are brought into communication with each other, ink meniscus formed at the ejection ports can be prevented from being broken when the buffer chamber 16 and the print head 22 are actually brought into communication with each other. Thus, the ink can be prevented from seeping out through the ejection ports.

In step S5, it is determined whether or not the ink sensor 24 is detecting ink, in other words, whether or not the amount of ink in the print head 22 exceeds the predetermined amount. If the ink sensor 24 is detecting ink, whether or not all images have been printed is determined (step S6). If not all the images have been printed, the negative pressure (V+V1) is updated to the negative pressure V (step S7), and then, the process returns to step S2 to repeat the above-described process. If all the images have been printed, the negative pressure relaxation process in FIG. 6 is ended.

In step S5, if the ink sensor 24 is detecting no ink, in other words, the amount of ink in the print head 22 is equal to or smaller than the predetermined amount, a suction operation is performed to reduce the pressure in the liquid chamber 10 in the print head 22 (step S8). This allows sucking of as much of the ink in the ink tank 28 as possible into the liquid chamber 10 in the print head 22. Specifically, in the suction operation, the first valve 17 is opened, and the pump 18 is rotated in a direction in which the pressure in the liquid chamber 10 in the print head 22 is reduced. Subsequently, whether or not the ink sensor 24 detects the ink is determined again (step S9). If the ink sensor 24 detects ink, the process proceeds to step S6. If the ink sensor 24 detects no ink, the user is urged to replace the ink tank 28 (step S10).

As described above, in the present example, the amount of ink consumed, which corresponds to the negative pressure in the print head, is acquired as information on the negative pressure in the print head. Then, when the amount of ink consumed is equal to or greater than the predetermined amount, in other words, when the negative pressure in the print head is equal to or higher than a predetermined negative pressure, the inside of the buffer chamber with the pressure therein reduced and the inside of the print head are temporarily kept in communication with each other to relax the negative pressure in the print head. Subsequently, the printing operation is resumed. Thus, during printing after the ink remaining in the ink tank is about to be exhausted, an increase in the negative pressure in the print head is suppressed to allow the appropriate ink ejection state to be maintained. As a result, the ink in the ink tank and in the print head can be maximally used without causing inappropriate image printing.

Second Embodiment

Figure 8:
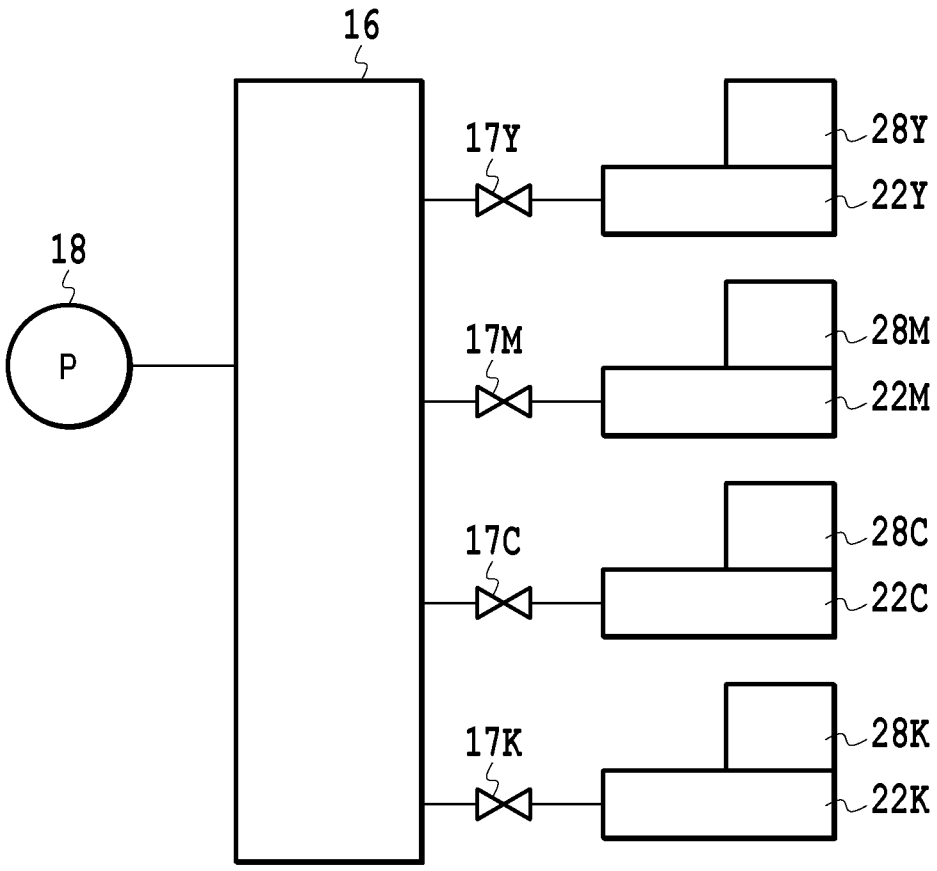
FIG. 8 is a schematic diagram of a configuration of an important part of a second embodiment of the present invention.

As shown in FIG. 8, a plurality of print heads may all be connected to a single buffer chamber. The remaining part of the configuration of a second embodiment is similar to the corresponding part of the first embodiment and will thus not be described. In the present example, four print heads 22 (22Y, 22M, 22C, and 22K) are connected to a single buffer chamber 16 via first valves 17 (17Y, 17M, 17C, and 17K). When the negative pressure in the print head 22Y is equal to or higher a predetermined negative pressure, the CPU 100 enables the negative pressure in the print head 22Y to be relaxed by preliminarily reducing the pressure in the buffer chamber 16 and then temporarily opening the first valve 17Y. This also applies to the other print heads 22M, 22C, and 22K.

In the above first embodiment, the valves 17 and 20 and the pump 18 are controlled based on a result of comparison of the predetermined negative pressure VA with the negative pressure (V+V1) resulting from accumulation of an increase V1 in the negative pressure in the print head 11 since the shift to the negative pressure relaxation mode. The negative pressure in the print head 22 corresponds to the negative pressure in the ink tank 28 corresponding to the amount of ink consumed which has been accumulated since the start of use of the ink tank 28, and thus, the accumulated amount of ink consumed can be used as information on the negative pressure in the print head 22. For example, the accumulated amount of ink consumed is compared with a predetermined threshold to determine whether or not the negative pressure in the print head 22 is equal to or higher than the predetermined negative pressure. Then, when the negative pressure in the print head 22 is equal to or higher than the predetermined negative pressure, the negative pressure in the print head 22 can be relaxed by bringing the buffer chamber 16 into communication with the print head 22.

In the above first embodiment, when the negative pressure in the print head becomes equal to or higher than the predetermined negative pressure in a period between a first printing operation of printing an image and a succeeding second printing operation, the negative pressure in the print head is relaxed by bringing the buffer chamber into communication with the print head in the period between the first and second printing operations. When the negative pressure in the print head 22 becomes equal to or higher than the predetermined negative pressure while an image is being printed, the negative pressure in the print head 22 can also be relaxed before the image is printed. For example, the amount of ink consumed when such an image is printed is predicted from the number of ink ejections counted based on print data needed to print the image, and the negative pressure in the print head 22 is predicted which is expected to be measured when the image is printed. When the predicted negative pressure in the print head 22 is equal to or higher than the predetermined negative pressure, the negative pressure in the print head 22 is relaxed before the image is printed.

The liquid chamber 10 in the print head 22 forms a relatively small space to sensitively react with a decrease in the negative pressure in the liquid chamber 10, allowing the ink to be reliably fed from the ink tank 28 to the liquid chamber 10 in the print head 22 through an ink holding member 14. When the liquid chamber 10 in the print head 22 comes into temporary communication with the buffer chamber 16, the volume of the liquid chamber 10 substantially increases. However, the substantial increase in the volume of the liquid chamber 10 is temporary, and when the substantial increase occurs, the printing operation in which the ink is ejected from the print head 22 is not being performed. Thus, the substantial increase is prevented from affecting the ink supply.

Third Embodiment

A printing apparatus according to a third embodiment enables the inside of the print head 22 to be pressed through the communication path 15 in the print head 22 in view of a case where the filter 27 provided in the communication path 15 is wet with the ink.

The filter 27 is provided in the communication path 15 to prevent foreign matter such as dust from entering the print head 22 through the communication path 15. If the foreign matter enters the print head 22 and migrates into the nozzle, the ink may be inappropriately ejected. Like the filter 13, the filter 27 has an average width of approximately 10 μm, is formed of SUS, and includes metal fibers woven in the filter 13.

If the ink in the print head 22 comes into contact with the filter 27 or the ink flows through the filter 27 to make the filter 27 temporarily wet with the ink, a membrane of the ink is formed in the meshes of the filter 27 to hinder gas from passing through the filter 27. Such a membrane is firmly held by the surface tension of the ink and thus blocks the pressure in spaces preceding and succeeding the filter 27 in the communication path 15. The magnitude of the force blocking the pressure increases with decreasing size of the meshes of the filter 27. If an attempt is made to adjust the negative pressure in the print head 22 through the communication path 15 as described above in the first embodiment after the above-described membrane of the ink, which blocks the pressure, is formed in the filter 27, the adjustment is difficult. That is, the membrane of the ink exerts a meniscus force, which may block the negative pressure to be introduced into the liquid chamber 10 in the print head 22 through the communication path 15. In this case, the negative pressure in the liquid chamber 10 is precluded from being reduced and may thus increase to prevent the ink from being appropriately ejected.

In the third embodiment, the membrane of the ink formed in the filter 27 is broken as a result of a difference in pressure in order to prevent the adjustment of the negative pressure in the print head 22 from being hindered. The membrane of the ink formed in the filter 27 can be broken by setting the difference in pressure between the spaces preceding and succeeding the filter 27 in the communication path 15, in other words, the difference in pressure between the spaces preceding and succeeding the membrane of the ink formed in the filter 27, equal to or greater than the meniscus force of the ink in magnitude. This enables gas to pass through the filter 27 to achieve a balance between the pressures in the spaces preceding and succeeding the filter 27 in the communication path 15.

Specifically, in the negative pressure relaxation process of adjusting the negative pressure in the print head 22, the pressure in the communication path 15 is adjusted from a buffer chamber 16 side so as to cause a difference in pressure between the spaces preceding and succeeding the filter 27 in the communication path 15. In the present example, the pressure in the communication path 15 is adjusted by introducing a positive pressure from the buffer chamber 16 into the communication path 15 so as to press the buffer chamber 16 side space in the communication path 15. When the pressure Pb in the buffer chamber 16, the meniscus force Pm of the membrane of the ink formed in the filter, and the pressure (negative pressure) Ph in the print head 22 are in a relation expressed by Formula (1), the membrane of the ink formed in the filter 27 can be broken.

$$Pb-Ph>Pm \quad (1)$$

Furthermore, the pressure Ph in the print head 22 is set higher than a predetermined pressure Pf as shown by:

$$Ph>Pf \quad (2)$$

The predetermined pressure Pf (negative pressure) is as follows. The appropriate ink ejection state may fail to be maintained if the pressure Ph in the print head 22 decreases to the predetermined pressure Pf or lower. The appropriate ink ejection state can be maintained when the pressure Ph in the print head 22 is higher than the predetermined pressure Pf.

The relation expressed by Formula (3) needs to be established in order to achieve the negative pressure relaxation process of adjusting the negative pressure in the print head 22 so as to establish the relation expressed by Formula (1) while maintaining the relation expressed by Formula (2).

$$Pb-Pm>Ph>Pf \quad (3)$$

Thus, the pressure Pb in the buffer chamber 16 may have such a magnitude as establishes Formula (4).

$$Pb>Pm+Pf \quad (4)$$

Figure 9:
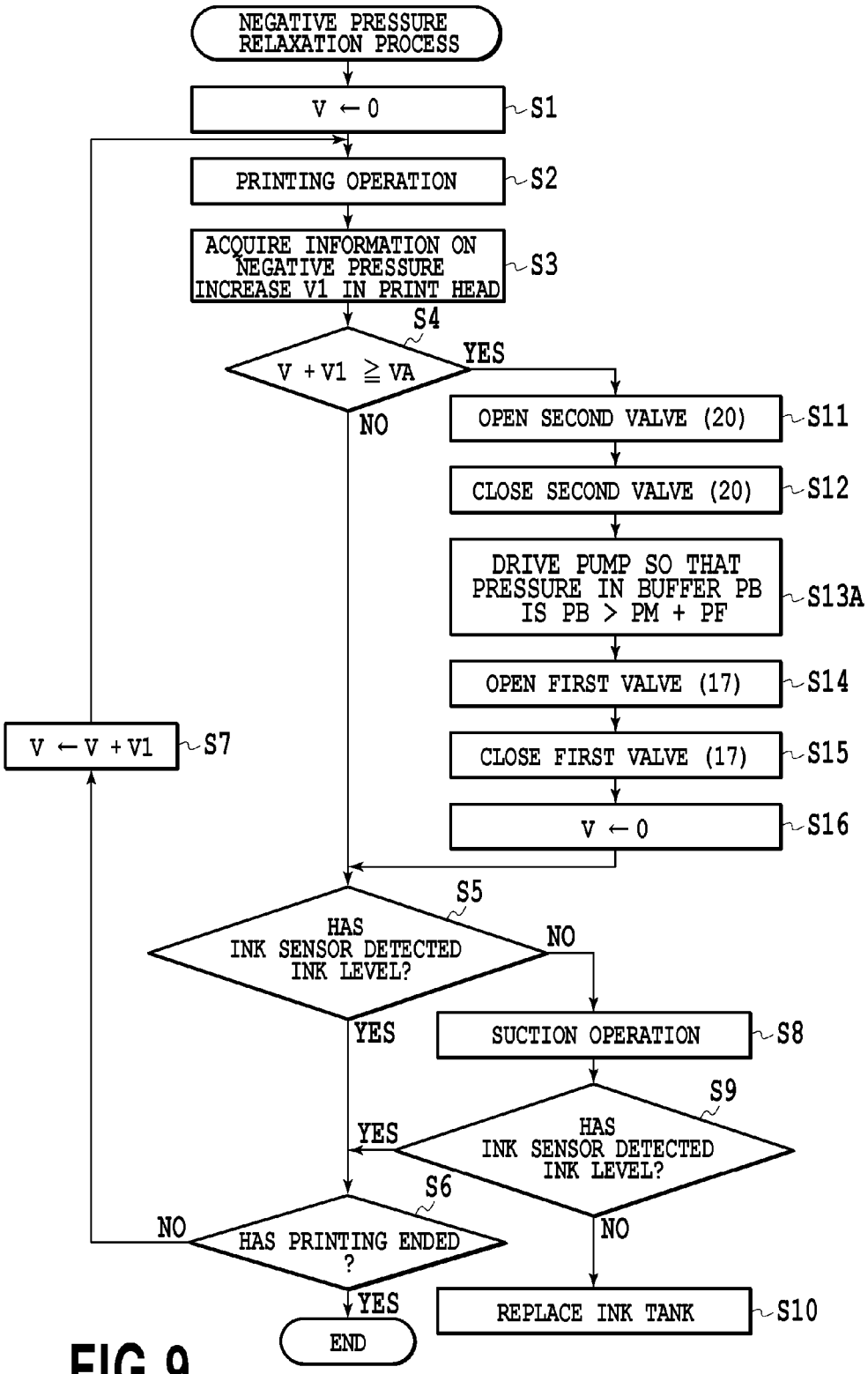
FIG. 9 is a flowchart illustrating a negative pressure relaxation process according to a third embodiment of the present invention.

As is the case with the first embodiment, in the third embodiment, the process shifts to the negative pressure relaxation mode upon determining that the ink in an ink tank is about to be exhausted. In the negative pressure relaxation mode, such a negative pressure relaxation process as shown in FIG. 9 is executed. Steps S1 to S10 are the same as steps S1 to S10 in the process described above in the first embodiment and shown in FIG. 6

Figure 10A:
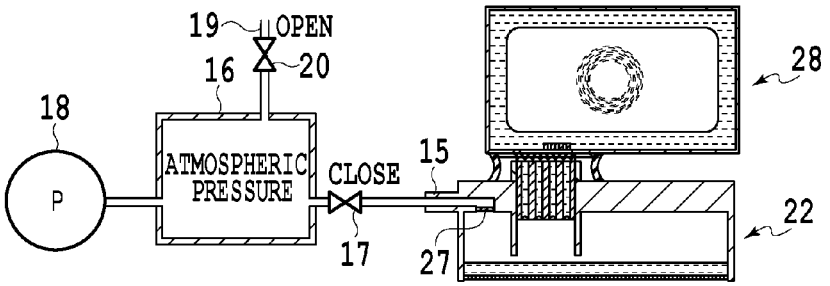
FIG. 10A, FIG. 10B, FIG. 10C, FIG. 10D, and FIG. 10E are diagrams illustrating an operation of the ink supply system during the negative pressure relaxation process in FIG. 9.
Figure 10B:
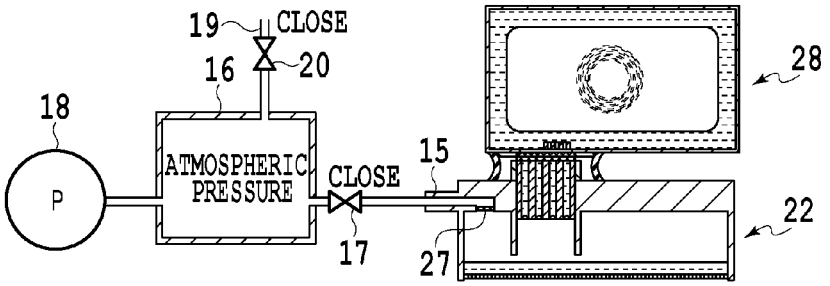
Figure 10C:
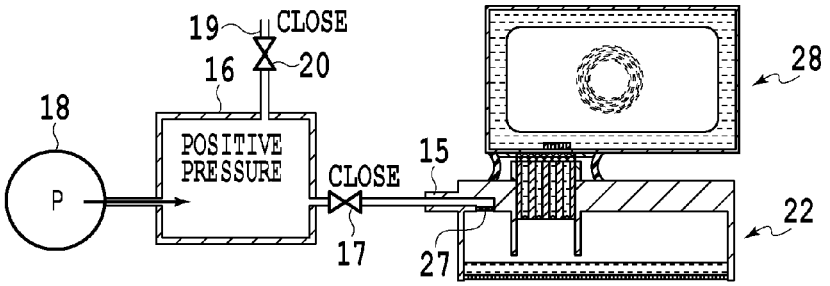
Figure 10D:
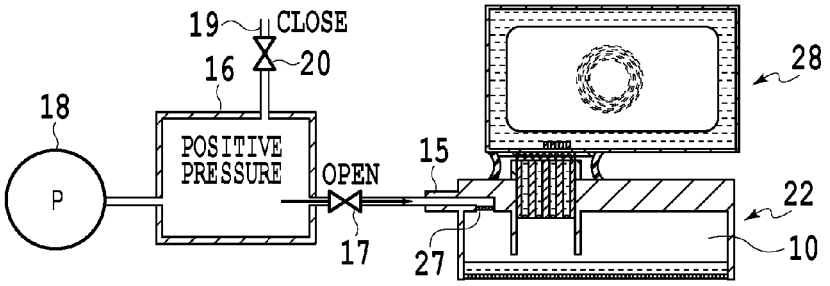
Figure 10E:
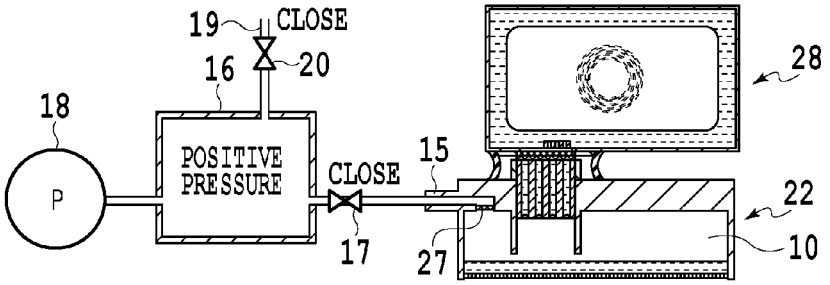

In step S11, as shown in FIG. 10A, the second valve 20 is opened with the first valve 17 and the third valve 33 remaining closed to set the pressure in the buffer chamber 16 equal to the atmospheric pressure. Subsequently, as shown in FIG. 10B, the second valve 20 is closed (step S12). As shown in FIG. 10C, the pump 18 is rotated in a direction in which air is introduced into the buffer chamber 16 (step S13A) to create a positive pressure in the buffer chamber 16. At this time, the buffer chamber 16 is used as a pressure chamber that is pressed. The pressure Pb in the buffer chamber 16 is Pb>Pm+Pf as shown by Formula (4). Then, the first valve 17 is opened as shown in FIG. 10D (step S14). Subsequently, the first valve 17 is closed as shown in FIG. 10E (step S15), and the negative pressure V is reset (step S16).

As shown in FIG. 10D, after the pressure (positive pressure) Pb in the buffer chamber 16 is introduced into the communication path 15, the pressure in the print head 22 decreases (the negative pressure increases) in conjunction with the printing operation. Then, when the pressure Ph in the print head 22 decreases down to Ph1, a difference in pressure between the spaces preceding and succeeding the filter 27 occurs which is greater in magnitude than the meniscus force Pm. As a result, if a membrane of the ink is formed in the filter 27, the membrane is broken. The pressure Ph1 can be set higher than the predetermined pressure Pf. Thus, the pressure Ph1 in the print head 22 is increased above the predetermined pressure Pf to enable the membrane of the ink formed in the filter 27 to be broken with the appropriate ink ejection state maintained. When the membrane of the ink formed in the filter 27 is thus broken, the pressure propagates through the filter 27 to relax the negative pressure in the print head 22. If the atmospheric pressure PA is introduced from the buffer chamber 16 into the communication path 15, the pressure in the print head 22 needs to be set to a value Ph2 smaller than the value PH1 in order to cause the difference in pressure between the spaces preceding and succeeding the filter 27 greater in magnitude than the meniscus force Pm. In that case, the pressure Ph2 is lower than the predetermined pressure Pf, possibly precluding the appropriate ink ejection state from being maintained.

Fourth Embodiment

For example, the printing apparatus may topple to cause the ink in the print head 22 to flow through the filter 27 into the communication path 15, with the ink remaining on the filter 27. The ink remaining on the filter 27 may clog the filter 27 to firmly block the pressures in the spaces preceding and succeeding the filter 27 in the communication path 15. When the ink remains on the filter 27, if the inside of communication path 15 is pressed from the inside of the buffer chamber 16 as described above in the third embodiment, the ink remaining on the filter 27 may move toward the print head 22 side without breaking the membrane of the ink. Thus, the pressure in the print head 22 increases to possibly cause the ink in the print head 22 to seep out through the ejection ports at the leading end of the nozzle.

In a fourth embodiment, when the process shifts to the negative pressure relaxation mode, the inside of the communication path 15 is pressed from the inside of the buffer chamber 16 to move the ink remaining on the filter 27 into the print head 22 to stabilize the subsequent negative pressure relaxation operation. At this time, since the ink may seep out through the ejection ports of the print head 22, the cap 34 and the print head 22 are arranged opposite each other so that the cap 34 can receive the ink. Furthermore, the ejection port formation surface of the print head 22 in which the ejection ports are formed is wiped to remove the ink seeping out through the ejection ports, thus cleaning the ejection port formation surface. As a result, the negative pressure relaxation operation can be stabilized, and the adverse effect, on the printing operation, of the ink seeping out through the ejection ports can be avoided.

Fifth Embodiment

An ink jet printing apparatus according to a fifth embodiment is similar to the ink jet printing apparatus according to the first embodiment. Thus, description of similar components is omitted. Differences from the first embodiment will be described below.

The CPU 100 executes various processes including a negative pressure relaxation process described below (see FIG. 11) based on process programs stored in the program ROM 104. The program ROM 104 stores process programs, tables, and the like corresponding to control flows. The work RAM 108 is used as a work memory or the lie. During the cleaning operation and the recovery operation for each of the print heads 22, the CPU 100 controllably drives the pump motor 124 via the output port 114 and the motor driving section 116 to allow the pump motor 124 to perform pressing, suction, and the like of the ink.

When an image needing a large amount of ink is printed after the ink in the ink tank 28 is exhausted, the ink in the print head 22 is consumed with no ink fed from the ink tank 28 to the print head 22. Thus, the negative pressure in the liquid chamber 10 in the print head 22 may increase to a level at which the ink is inappropriately ejected. An image needing a large amount of ink is printed when an image size per page is large with respect to the rolled paper P and when an image printing density per page is high. Such an image needing a large amount of ink is also printed when sheets in units of pages are used as print media.

In the present example, the negative pressure relaxation process is executed to suppress an increase in the negative pressure in the liquid chamber 10 of the print head 22 during a printing operation after the ink in the ink tank 28 is exhausted. Thus, high grade images can be printed with the appropriate ink ejection state maintained.

Figure 11:
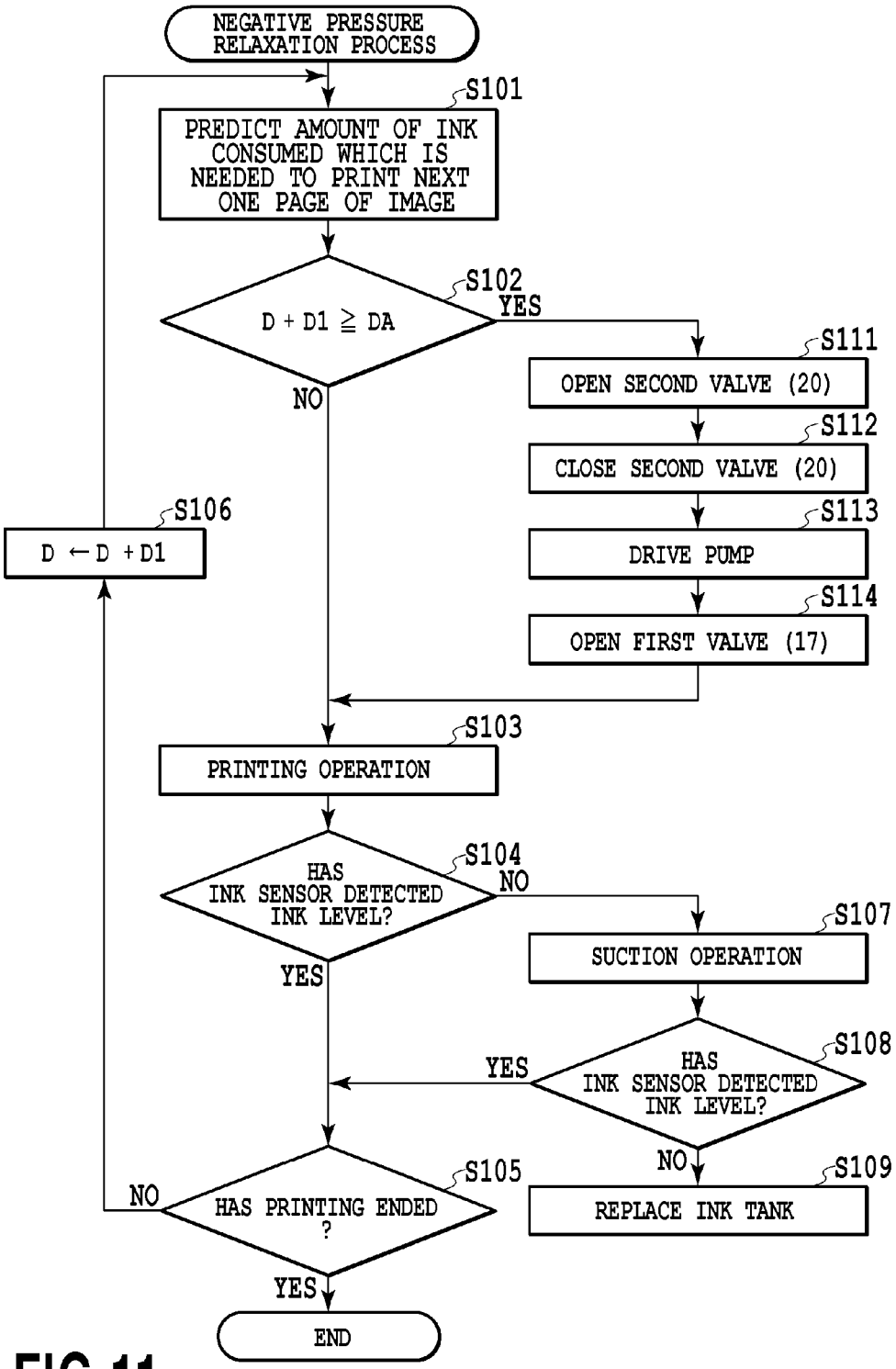
FIG. 11 is a flowchart illustrating a negative pressure relaxation process executed by the ink supply system in FIG. 3 according to a fifth embodiment of the present invention.

FIG. 11 is a flowchart illustrating the negative pressure relaxation process. FIGS. 12A to 12D are diagrams illustrating how the negative pressure in the print head 22 is adjusted during the negative pressure relaxation process.

The printing apparatus sequentially measures and accumulates the amount of ink consumed since the start of use of the ink tank 28 by counting the number of times that the ink is ejected from the print head 22 during the printing operation based on print data. Moreover, the amount of ink consumed can be more accurately measured by adding the amount of ink consumed as a result of the recovery operation (including the suction recovery operation, the preliminary ejection operation, and the pressing recovery operation) or the like to the amount of ink consumed as a result of the printing operation. The thus calculated amount of ink consumed is stored in a storage element provided in the ink tank 28. Therefore, for the ink in the ink tank 28 in which the storage element is provided, the accumulated amount of ink consumed D is stored in the storage element. When the accumulated amount of ink consumed D, which is stored in the storage element, is equal to or greater than a predetermined amount, the apparatus determines that the ink in the ink tank 28 is exhausted and shifts to a negative pressure relaxation mode shown in FIG. 11.

Upon shifting to the negative pressure relaxation mode, the apparatus first predicts the amount of ink consumed D1 which is needed to print an amount of image equivalent to the next one page on the rolled paper p (unit print image), based on the print data (step S101). Specifically, the number of ink ejections needed to print the next one page is counted based on the print data, and the amount of ink consumed D1 is predicted based on the count value and the amount of ink needed for one ink ejection. Then, the apparatus determines whether or not the total (D+D1) of the amount of ink consumed D1 and the above-described accumulated amount of ink consumed D is quell to or greater than a predetermined amount DA (step S102). The predetermined amount DA is such that, even when the total amount of ink consumed (D+D1) reaches such a level, the negative pressure in the liquid chamber 10 of the print head 22 is prevented from increasing to the extent that the appropriate ink ejection state fails to be maintained. However, when the total amount of ink consumed (D+D1) exceeds the predetermined amount DA to some degree, the negative pressure in the liquid chamber 10 of the print head 22 may increase to the extent that the appropriate ink ejection state fails to be maintained. Association of the number of ink ejections with the amount of ink consumed also allows determination of whether or not the total amount of ink consumed (D+D1) is equal to or greater than the predetermined amount DA based on determination of whether or not the number of ink ejections has reached a specified value since the shift to the negative pressure relaxation mode.

Figure 12A:
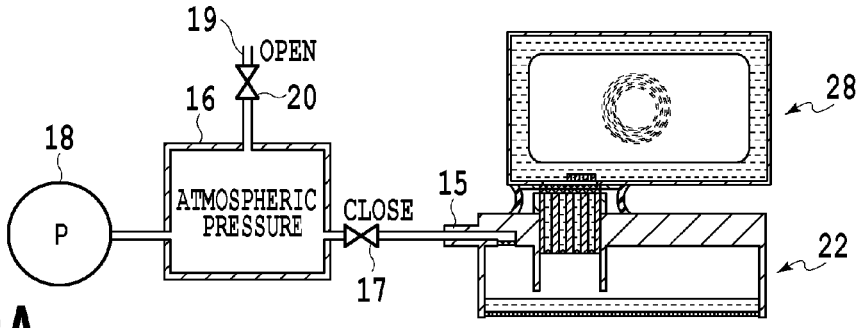
FIG. 12A, FIG. 12B, FIG. 12C, and FIG. 12D are diagrams illustrating an operation of the ink supply system during the negative pressure relaxation process in FIG. 11.
Figure 12B:
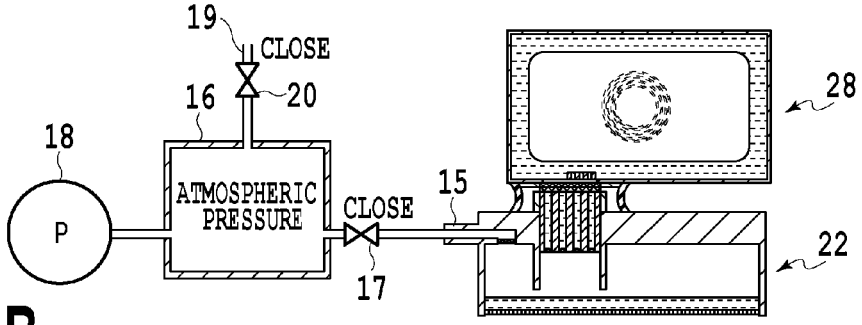
Figure 12C:
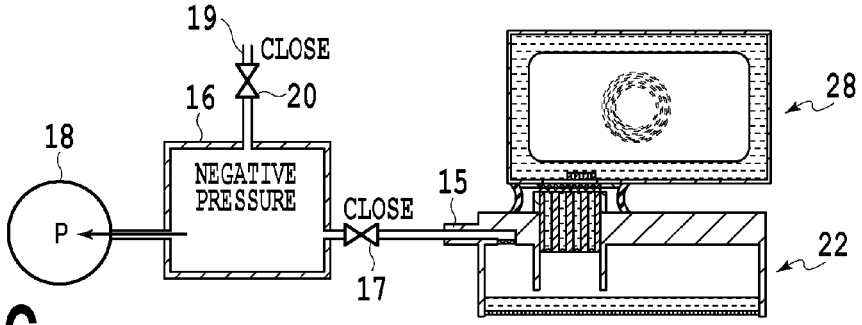
Figure 12D:
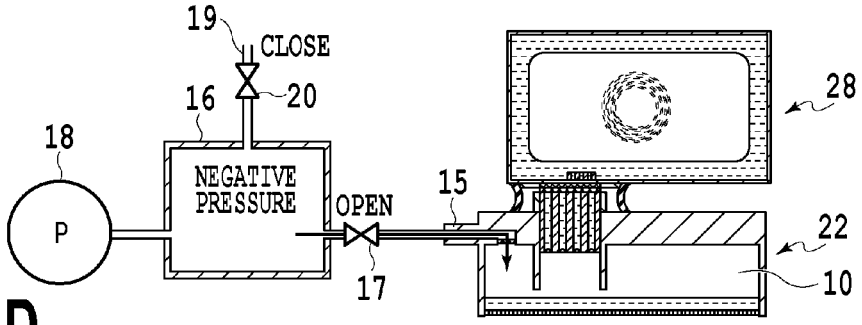

When the total amount of ink consumed (D+D1) is smaller than the predetermined amount DA, the next one page of image is printed (step S103). On the other hand, when the total amount of ink consumed (D+D1) is equal to or greater than the predetermined amount DA, a series of processing is executed to bring the liquid chamber 10 in the print head 22 and the buffer chamber 16 into communication with each other (steps S111, S112, S113, and S114). That is, first, the second valve 20 is opened with the first valve 17 and the third valve 33 remaining closed to set the pressure in the buffer chamber 16 equal to the atmospheric pressure (step S111), as shown in FIG. 12A. Subsequently, as shown in FIG. 12B, the second valve 20 is closed (step S12). As shown in FIG. 12C, the pump 18 is rotated in a direction in which the air in the buffer chamber 16 is discharged (step S113) to create a negative pressure in the buffer chamber 16. Subsequently, the negative pressure in the buffer chamber 16 is made equivalent to the negative pressure in the liquid chamber 10 in the print head 22. Then, the first valve 17 is opened as shown in FIG. 12D (step S114). After the buffer chamber 16 and the liquid chamber 10 in the print head 22 are thus brought into communication with each other, the next one page of image is printed (step S103). The internal pressure of the buffer chamber 16 can be adjusted to a value equivalent to the negative pressure in the liquid chamber 10 in the print head 22, for example, based on the amount of rotation of a tube pump serving as the pump 18 or on a detection signal from a sensor that detects the pressure in the buffer chamber 16. This adjustment of the pressure in the buffer chamber 16 enables a variation in the pressure in the liquid chamber 10 to be reduced when the buffer chamber 16 and the liquid chamber 10 in the print head 22 are brought into communication with each other.

This communication between the buffer chamber 16 and the liquid chamber 10 in the print head 22 forms the air layer 12 in the liquid chamber 10 so that the air layer 12 spans an area including the inside of the buffer chamber 16. In other words, the communication substantially increases the volume of a space portion in the liquid chamber 10 of the print head 22 in which air is present. Thus, during the printing operation after the ink in the ink tank 28 is exhausted (step S104), the air in the substantially expanded liquid chamber 10 suppresses an increase in the negative pressure in the liquid chamber 10 to allow the appropriate ink ejection state to be maintained.

Figure 13:
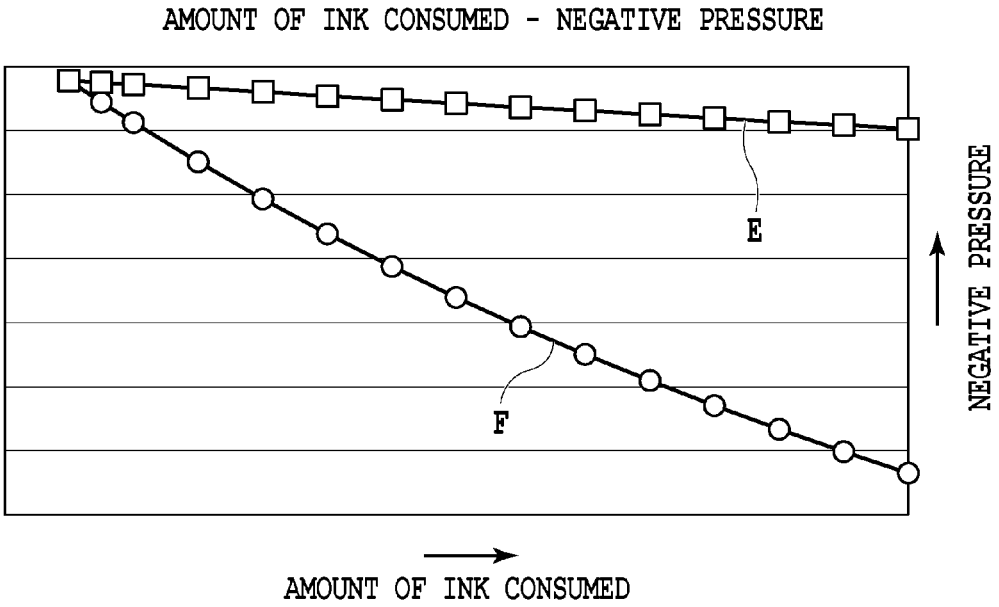
FIG. 13 is a diagram illustrating a relation between the amount of ink consumed and the negative pressure in the print head.

FIG. 13 is a diagram illustrating the relation between the negative pressure in the liquid chamber 10 in the print head 22 and the amount of ink consumed in conjunction with the printing operation after the total amount of ink consumed (D+D1) becomes equal to or greater than the predetermined amount DA. The substantial expansion of the space in the liquid chamber 10 as in the present example enabled an increase in the negative pressure in the liquid chamber 10 to be reduced as shown by a curve E. When the liquid chamber 10 in the print head 22 was not brought into communication with the buffer chamber 16, in other words, the space in the liquid chamber 10 was not substantially expanded, the negative pressure in the liquid chamber 10 increased as shown by a curve F.

After the printing operation (step S103), the apparatus determines whether or no the ink sensor 24 is electrically conductive, in other words, whether or not the amount of ink in the print head 22 is greater than the predetermined amount (step S104). When the ink sensor 24 is detecting ink, the apparatus determines whether or not all the images have been printed (step S105). When not all the images have been printed, the apparatus updates the amount of ink consumed (D+D1) to the accumulated amount of ink consumed D (step S106) and then returns to step S101 to repeat the above-described processing. When all the images have been printed, the apparatus ends the negative pressure relaxation process in FIG. 11.

In step S104, when the ink sensor 24 is not detecting ink, in other words, when the amount of ink in the print head 22 is equal to or smaller than the predetermined amount, a suction operation is performed to reduce the pressure in the liquid chamber 10 in the print head 22 (step S107). This allows as much of the ink in the ink tank 28 as possible to be sucked into the liquid chamber 10 (into the ink chamber) in the print head 22. Specifically, the first valve 17 is opened, and the pump 18 is rotated in the direction in which the pressure in the liquid chamber 10 in the print head 22 is reduced. Subsequently, whether or not the ink sensor 24 detects ink is determined again (step S108). When the ink sensor 24 detects ink, the process proceeds to step S106. When the ink sensor 24 fails to detect ink, the user is urged to replace the ink tank 28 (step S109).

As described above, when the ink in the closed ink tank is exhausted, the space portion in the liquid chamber in the print head is substantially expanded to substantially increase the amount of air in the space portion. This suppresses an increase in the negative pressure in the liquid chamber in the print head during the subsequent printing operation to allow the appropriate ink ejection state to be maintained. As a result, the ink in the ink tank and the print head can be maximally used without causing inappropriate printing of images. Furthermore, a relatively small space present in the liquid chamber in the print head before the substantial expansion can appropriately react with a decrease in the pressure in the liquid chamber to allow the ink to be reliably fed from the ink tank through an ink holding member into the print head, as described above. In this manner, in a normal state where ink is present in the ink tank, the relatively small space in the print head appropriately reacts with a decrease in pressure to reliably feed the ink. On the other hand, when the ink in the ink tank is exhausted, the substantially expanded space in the print head relaxes an increase in the negative pressure in the print head.

Sixth Embodiment

In the apparatus configuration according to the fifth embodiment, a plurality of print heads may all be connected to one buffer chamber as shown in FIG. 8. The remaining part of the configuration in a sixth embodiment is similar to the corresponding part of the configuration according to the above-described embodiments. In the present example, four print heads 22 (22Y, 22M, 22C, and 22K) are connected to one buffer chamber 16 via corresponding first valves 17 (17Y, 17M, 17C, and 17K). When the ink in the ink tank 28Y is exhausted, the CPU 100 opens the first valve 17Y to bring the liquid chamber in the print head 22Y and the buffer chamber 16 into communication with each other so as to substantially increase the liquid chamber in the print head 22Y. This also applies to the other print heads 22M, 22C, and 22K.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-195873, filed Sep. 20, 2013, No. 2013-195875, filed Sep. 20, 2013, and No. 2014-058462, filed Mar. 20, 2014, which are hereby incorporated by reference herein in their entirety.

What is claimed is:

1. An ink jet printing apparatus comprising:

a print head configured to be able to eject an ink fed from an ink tank that contains the ink in a closed space, the ink tank comprising a negative pressure generating section;

a buffer chamber;

a communication path configured to allow a liquid chamber in the print head to communicate with the buffer chamber, negative pressure in the liquid chamber being made by the negative pressure generating section of the ink tank;

an opening and closing unit configured to open and close the communication path;

a pressure determining unit configured to determine a pressure in the liquid chamber; and a control unit configured to open the communication path via the opening and closing unit based on the pressure in the liquid chamber determined by the pressure determining unit, to regulate the pressure in the liquid chamber within a predetermined range by pressure in the buffer chamber.

2. The ink jet printing apparatus according to claim 1, wherein the control unit opens the communication path via the opening and closing unit when the negative pressure in the liquid chamber is equal to or greater than a predetermined negative pressure.

3. The ink jet printing apparatus according to claim 2, wherein, when the negative pressure in the liquid chamber is equal to or greater than the predetermined negative pressure, an amount of ink consumed in the ink tank is equal to or greater than a predetermined amount.

4. The ink jet printing apparatus according to claim 3, wherein the amount of ink consumed is determined based on a number of times that ink is ejected from the print head.

5. The ink jet printing apparatus according to claim 2, wherein, in a case where the negative pressure in the liquid chamber becomes equal to or greater than the predetermined negative pressure in a period between a first printing operation of ejecting ink from the print head to print an image and a succeeding second printing operation, the control unit temporarily opens the communication path via the opening and closing unit in the period between the first printing operation and the succeeding second printing operation.

6. The ink jet printing apparatus according to claim 2, wherein, in a case where the negative pressure in the liquid chamber becomes equal to or greater than the predetermined negative pressure during a printing operation of ejecting ink from the print head to print an image, the control unit temporarily opens the communication path via the opening and closing unit before the printing operation.

7. The ink jet printing apparatus according to claim 1, further comprising:

a detection unit configured to detect an amount of ink in the print head; and a pressure reducing unit configured to reduce the pressure in the liquid chamber so as to suck ink from the ink tank into the print head when the amount of the ink detected by the detection unit is equal to or smaller than a predetermined amount.

8. The ink jet printing apparatus according to claim 1, further comprising a channel between the ink tank and the print head configured to allow feeding of ink from the closed space into the print head based on a difference in pressure between an inside of the closed space and an inside of the print head.

9. The ink jet printing apparatus according to claim 1, wherein the liquid chambers of a plurality of print heads communicate with a single buffer chamber via corresponding communication paths.

10. The ink jet printing apparatus according to claim 1, wherein the communication path comprises a filter.

11. The ink jet printing apparatus according to claim 1, further comprising a pressure adjusting unit configured to be able to pressurize an inside of the print head through the buffer chamber.

12. The ink jet printing apparatus according to claim 1, wherein the print head is able to eject the ink through an ejection port formed in an ejection port formation surface, and the ink jet printing apparatus further comprises a cleaning unit configured to clean the ejection port formation surface of the print head when the control unit regulates the pressure in the liquid chamber.

13. A printing method for printing an image by ejecting, from a print head comprising a liquid chamber, ink fed from an ink tank that contains the ink in a closed space, the ink tank comprising a negative pressure generating section, negative pressure in the liquid chamber being made by the negative pressure generating section of the ink tank, the method comprising:

a pressure detecting step of detecting pressure in the liquid chamber; and a control step of opening a communication path to allow communication between the liquid chamber and a buffer chamber based on the pressure in the liquid chamber detected in the pressure detecting step, and regulating the pressure in the liquid chamber within a predetermined range by pressure in the buffer chamber communicating with the communication path.

* * * * *